US008905003B2

(12) United States Patent
Morita et al.

(10) Patent No.: US 8,905,003 B2
(45) Date of Patent: Dec. 9, 2014

(54) FUEL INJECTOR WITH FUEL PRESSURE SENSOR AND ELECTRICAL INTERCONNECTION METHOD OF THE SAME

(75) Inventors: Kouji Morita, Nishio (JP); Yutaka Miyamoto, Takahama (JP); Jun Kondo, Nagoya (JP); Tomoki Fujino, Okazaki (JP)

(73) Assignee: Denso Corporation, Kariya (JP)

( * ) Notice: Subject to any disclaimer, the term of this patent is extended or adjusted under 35 U.S.C. 154(b) by 1287 days.

(21) Appl. No.: 12/753,287

(22) Filed: Apr. 2, 2010

(65) Prior Publication Data

US 2010/0252001 A1 Oct. 7, 2010

(30) Foreign Application Priority Data

Apr. 3, 2009 (JP) ..... 2009-090733

(51) Int. Cl.
*F02M 51/00* (2006.01)
*F02M 57/00* (2006.01)
*F02M 61/16* (2006.01)

(52) U.S. Cl.
CPC ..... *F02M 57/005* (2013.01); *F02M 51/005* (2013.01); *F02M 61/168* (2013.01); *F02M 2200/24* (2013.01); *F02M 2200/8046* (2013.01); *F02M 2200/8076* (2013.01)
USPC ..... 123/472; 123/435; 123/478; 123/494; 123/498; 73/114.43; 73/114.45; 73/114.51

(58) Field of Classification Search
CPC ..... F02M 2200/24; F02M 2200/247; F02M 51/005
USPC ..... 123/435, 472, 478, 494, 498; 701/103; 73/114.43, 114.45, 114.51
See application file for complete search history.

(56) References Cited

U.S. PATENT DOCUMENTS

| | | | | |
|---|---|---|---|---|
| 4,373,671 | A * | 2/1983 | Giardini | |
| 4,630,465 | A * | 12/1986 | Hatton | |
| 5,129,834 | A * | 7/1992 | Cranford | 439/130 |
| 6,260,537 | B1 * | 7/2001 | Lamb et al. | 123/456 |
| 6,590,162 | B1 * | 7/2003 | Luedicke et al. | 174/135 |
| 7,096,726 | B2 * | 8/2006 | Brock | 73/114.51 |
| 7,168,325 | B2 * | 1/2007 | Yoshino | 73/754 |
| 7,225,777 | B2 * | 6/2007 | Barrena et al. | 123/143 C |
| 7,412,894 | B2 * | 8/2008 | Ueyanagi et al. | 73/753 |
| 7,552,717 | B2 * | 6/2009 | Dingle | 123/480 |

(Continued)

FOREIGN PATENT DOCUMENTS

JP 2008-144749 6/2008

*Primary Examiner* — Mahmoud Gimie
*Assistant Examiner* — David Hamaoui
(74) *Attorney, Agent, or Firm* — Nixon & Vanderhye PC

(57) ABSTRACT

In a fuel injector, a body has formed therein a spray hole and a fuel supply passage. Fuel supplied to the fuel supply passage is delivered to the spray hole. A fuel pressure sensor produces a signal indicative of a pressure of the fuel. First terminals are attached to the fuel pressure sensor and include a terminal for outputting the signal. The fuel pressure sensor is threadedly installed in the body while the first terminals are rotated. A connector includes a housing attached to the body, and second terminals supported by the housing for external electric connection of the fuel pressure sensor. Wires are operative to establish electrical connection between the first terminals and the second terminals. A wire holder is configured to hold each of the plurality of wires at least partly around the fuel pressure sensor.

18 Claims, 8 Drawing Sheets

(56) References Cited

U.S. PATENT DOCUMENTS

| | | | | |
|---|---|---|---|---|
| 7,810,472 | B2 * | 10/2010 | Kondo et al. | 123/456 |
| 7,900,605 | B2 * | 3/2011 | Dingle | 123/480 |
| 7,918,128 | B2 * | 4/2011 | Kondo et al. | 73/114.43 |
| 7,931,009 | B2 * | 4/2011 | Kondo et al. | 123/490 |
| 7,963,155 | B2 * | 6/2011 | Kondo et al. | 73/114.43 |
| 8,100,344 | B2 * | 1/2012 | Kondo et al. | 239/74 |
| 8,224,554 | B2 * | 7/2012 | Kondo et al. | 701/104 |
| 8,297,259 | B2 * | 10/2012 | Kondo et al. | 123/494 |
| 8,342,155 | B2 * | 1/2013 | Fujino et al. | 123/472 |
| 8,375,924 | B2 * | 2/2013 | Kondo et al. | 123/494 |
| 8,402,945 | B2 * | 3/2013 | Fujino et al. | 123/435 |
| 8,402,949 | B2 * | 3/2013 | Kondo et al. | 123/490 |
| 8,402,950 | B2 * | 3/2013 | Fujino et al. | 123/494 |
| 8,469,006 | B2 * | 6/2013 | Cooke | 123/478 |
| 8,474,438 | B2 * | 7/2013 | Kondo et al. | 123/494 |
| 2008/0228374 | A1 | 9/2008 | Ishizuka et al. | |
| 2010/0263633 | A1 * | 10/2010 | Kondo et al. | 123/478 |
| 2010/0264239 | A1 * | 10/2010 | Kondo et al. | 239/533.3 |

* cited by examiner

FUEL INJECTOR WITH FUEL PRESSURE SENSOR AND ELECTRICAL INTERCONNECTION METHOD OF THE SAME

CROSS REFERENCE TO RELATED APPLICATIONS

This application is based on Japanese Patent Application 2009-090733 filed on Apr. 3, 2009. This application claims the benefit of priority from the Japanese Patent Applications, so that the descriptions of which are all incorporated herein by reference.

FIELD OF THE INVENTION

The present invention relates to fuel injectors each having a fuel pressure sensor, and electrical interconnection methods of fuel injectors. More particularly, the present invention relates to such fuel injectors installable in an internal combustion engine; these fuel injectors working to spray fuel via their spray holes. In addition, the present invention relates to electrical interconnection methods of these fuel injectors.

BACKGROUND OF THE INVENTION

Fuel injectors are operative to spray, via their spray holes, high-pressurized fuel supplied from a common rail, such as a fuel accumulator, in which high-pressurized fuel is charged. These fuel injectors are installed in internal combustion engines and operative to spray high-pressurized fuel into cylinders of the internal combustion engines.

In order to control, with high accuracy, the output torque of internal combustion engines and the characteristics of emissions therefrom, it is required to properly adjust fuel-spray characteristics of fuel injectors, such as the fuel-spray start timing of each fuel injector and the quantity of fuel to be sprayed therefrom.

For meeting such a requirement, there have been proposed techniques that monitor the change in pressure of fuel caused when a fuel injector sprays fuel.

One of the techniques uses a fuel pressure sensor provided directly in the common rail and operative to measure the pressure of fuel charged in the common rail. However, in this technique, the change in pressure of fuel caused when the fuel injector sprays fuel may be somewhat absorbed within the common rail; these results may reduce the accuracy of measuring such a pressure change.

In order to address such a drawback, US Patent Application Publication No. 2008/0228374 corresponding to Japanese Patent Application Publication No. 2008-144749 discloses an alternative one of the techniques that uses a fuel pressure sensor installed in a fuel injector.

Specifically, this technique aims at measuring the change in pressure of fuel caused when the pressure-sensor installed fuel injector sprays fuel without the pressure change being absorbed within the common rail.

SUMMARY OF THE INVENTION

The inventors have proposed fuel injectors designed such that fuel pressure sensors are threaded in their bodies.

In such a fuel injector having this design, a plurality of terminals (sensor terminals), such as an external output terminal, a power supply terminal, a ground terminal, and the like, are attached to the fuel pressure sensor, and a plurality of connector terminals for external connection of the sensor terminals are attached to the body of the fuel injector. The sensor terminals and the connector terminals are electrically connected to each other for driving the fuel pressure sensor and outputting detection signals thereby.

In producing a plurality of fuel injectors each having the design, because the fuel pressure sensor is screwed about its axial direction into the body of each fuel injector, at the moment when the screwing of the fuel pressure sensor into the body of each fuel injector is completed, rotational positions of the sensor terminals of the fuel pressure sensors may be unspecified among the fuel injectors.

On the other hand, the connector terminals are required to be attached to predetermined positions of the body of each fuel injector.

For this reason, in wiring the plurality of sensor terminals and the plurality of connector terminals, the wiring routes between the plurality of sensor terminals and the plurality of connector terminals may be unspecified among the fuel injectors. This may cause adjacent wires to be interfered with each other.

In view of the circumstances set force above, the present invention seeks to provide fuel injectors with fuel pressure sensors, each of which is designed to facilitate respective electrical connections between a plurality of terminals of the fuel pressure sensor and a plurality of terminals of a connector for external electric connection of the fuel pressure sensor. The present invention also seeks to provide electrical interconnection methods of such fuel injectors.

According to one aspect of the present invention, there is provided a fuel injector to be installed in an internal combustion engine to spray fuel from a spray hole. The fuel injector includes a body having formed therein a spray hole and a fuel supply passage, the fuel supply passage being designed such that fuel supplied thereto is delivered to the spray hole. The fuel injector includes a fuel pressure sensor designed to produce a signal indicative of a pressure of the fuel, and a plurality of first terminals attached to the fuel pressure sensor and including at least one terminal for outputting the signal indicative of the pressure of the fuel. The fuel pressure sensor is threadedly installed in the body while the plurality of first terminals are rotated. The fuel injector includes a connector comprising a housing attached to the body, and a plurality of second terminals supported by the housing for external electric connection of the fuel pressure sensor. The fuel injector includes a plurality of wires for establishing electrical connection between the plurality of first terminals and the plurality of second terminals. The fuel injector includes a wire holder configured to hold each of the plurality of wires at least partly around the fuel pressure sensor.

At the moment when the threaded installation of the fuel pressure sensor into the body is completed, rotational positions of the plurality of first terminals may be unspecified among a plurality of the fuel injectors.

At that time, the fuel injector according to the one aspect of the present invention is configured such that the wire holder is configured to hold each of the plurality of wires at least partly around the fuel pressure sensor.

The configuration locates an end portion (see P in FIG. 5) of each of the plurality of wires at a fixed position around the fuel pressure sensor when the holding of a corresponding wire to the wire holder is completed. Thus, a wiring route between the end portion of each of the plurality of wires and a corresponding one of the plurality of second terminals remains constant independently of the rotational positions of the plurality of first terminals.

This advantage makes it possible to easily prevent adjacent ones of the plurality of wires from being interfered with each other.

According to another aspect of the present invention, there is provided an electrical interconnection method of a fuel injector to be installed in an internal combustion engine to spray fuel from a spray hole. The fuel injector includes a body having formed therein a spray hole and a fuel supply passage, the fuel supply passage being designed such that fuel supplied thereto is delivered to the spray hole. The fuel injector includes a fuel pressure sensor designed to produce a signal indicative of a pressure of the fuel, and a plurality of first terminals attached to the fuel pressure sensor and including at least one terminal for outputting the signal indicative of the pressure of the fuel. The fuel pressure sensor is threadedly installed in the body while the plurality of first terminals are rotated. The fuel injector includes a connector comprising a housing attached to the body, and a plurality of second terminals supported by the housing for external electric connection of the fuel pressure sensor. The fuel injector includes a plurality of wires for establishing electrical connection between the plurality of first terminals and the plurality of second terminals. The fuel injector includes a wire holder configured to hold each of the plurality of wires at least partly around the fuel pressure sensor. The electrical interconnection method includes threadedly installing the fuel pressure sensor into the body of the fuel injector while the plurality of first terminals are rotated therewith, and electrically connecting the plurality of wires to one of the plurality of first terminals of the fuel pressure sensor and the plurality of second terminals, respectively. The electrical interconnection method includes causing the plurality of wires to be held by the wire holder so that each of the wires is located at least partly around the fuel pressure sensor, and electrically connecting the plurality of wires to the other of the plurality of first terminals of the fuel pressure sensor and the plurality of second terminals, respectively.

At the moment when the threaded installation of the fuel pressure sensor into the body is completed by the threaded installing step, rotational positions of the plurality of first terminals may be unspecified among a plurality of the fuel injectors.

At that time the electrical interconnection method according to another aspect of the present invention is configured such that the plurality of wires are held by the wire holder so that each of the wires is located at least partly around the fuel pressure sensor.

Thus, when the next electrical connecting step is carried out, an end portion (see P in FIG. 5) of each of the plurality of wires is located at a fixed position around the fuel pressure sensor. Thus, a wiring route between the end portion of each of the plurality of wires and a corresponding one of the plurality of second terminals remains constant independently of the rotational positions of the plurality of first terminals.

This advantage makes it possible to easily prevent adjacent ones of the plurality of wires from being interfered with each other.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS OF THE INVENTION

Figure 1:
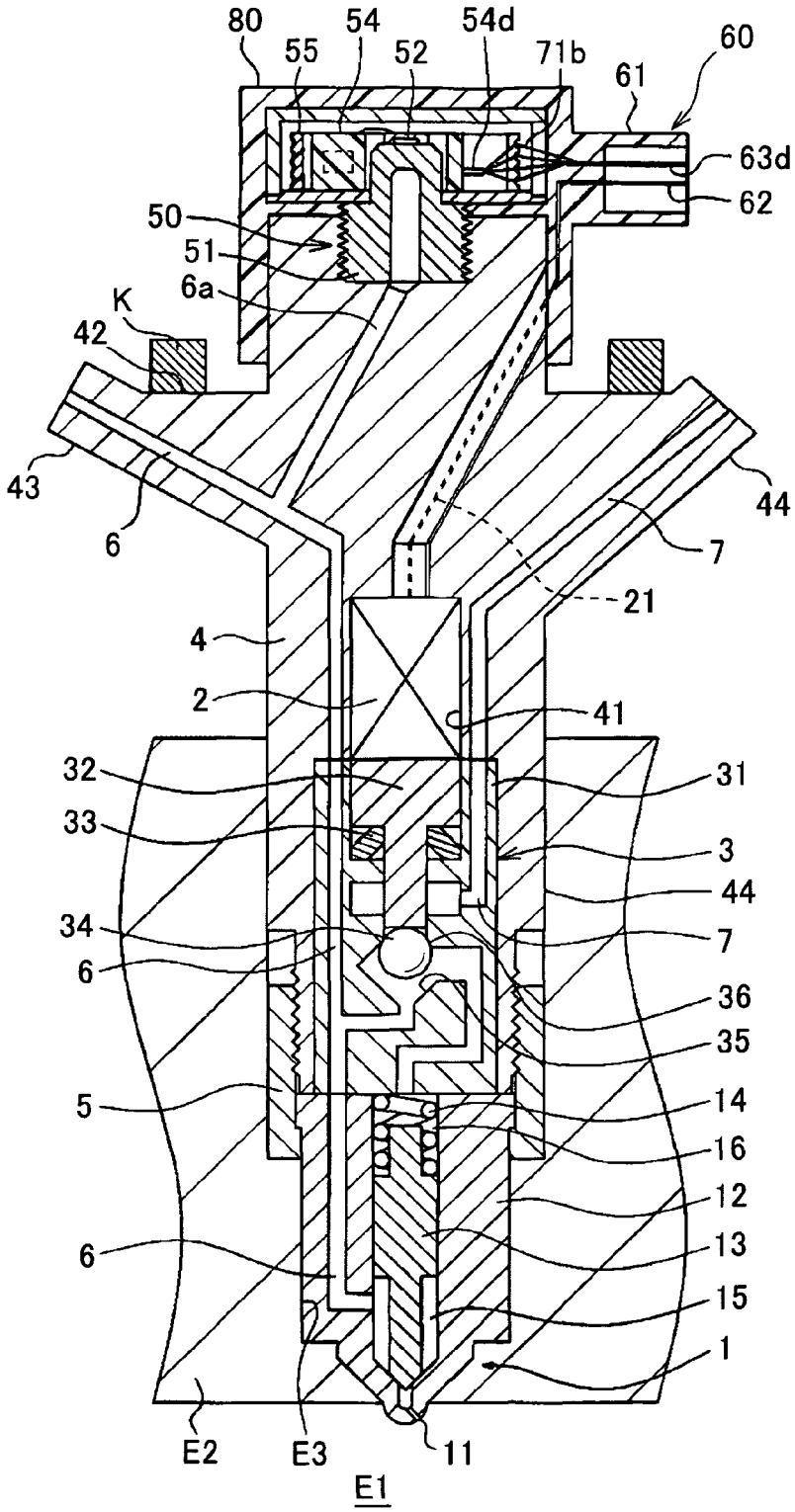
FIG. 1 is a longitudinal sectional view that shows an internal structure of a fuel injector according to the first embodiment of the present invention.

Embodiments of the present invention will be described hereinafter with reference to the accompanying drawings. In the drawings, identical reference characters are utilized to identify identical corresponding components.

First Embodiment

The first embodiment constructed by embodying one aspect of the present invention will be described hereinafter with reference to FIGS. 1 to 4. The first embodiment provides a fuel injector as being used in, for example, automotive common rail fuel injection systems for diesel engines.

The fuel injector is operative to inject, into a combustion chamber E1 in a cylinder of an internal combustion diesel engine, the high-pressurized fuel stored in a common rail (an accumulator), which is not illustrated in FIG. 1.

The fuel injector is comprised of a nozzle 1 from which the fuel is sprayed, an electrical actuator (driving member) 2 for actuating the nozzle 1 when energized, and a back-pressure control mechanism 3 driven by the electrical actuator 2 to control the back pressure acting on the nozzle 1.

The nozzle 1 is made up of a nozzle body 12 in which a spray hole(s) 11 is formed, a needle (needle valve) 13 movable into or out of abutment with an inner seat of the nozzle body 12 to close or open the spray hole 11, and a spring 14 operative to urge the needle 13 in a valve-closing direction to close the spray hole 11.

In the first embodiment, as the electrical actuator 2, a piezoelectric actuator is used. The piezoelectric actuator 2 includes a piezo stack made up of a plurality of laminated piezoelectric devices. The piezoelectric actuator 2 is designed to expand when electrically charged and to contract when discharged, thus functioning as an actuator to move the needle 13. As the electrical actuator, an electromagnetic actuator made up of a stator and an armature can be used.

The back-pressure control mechanism 3 includes a valve body 31 within which a piston 32, a disc spring 33, and a ball valve 34 are disposed. The piston 32 is movable with the stroke of the piezoelectric actuator 2. The disc spring 33 urges the piston 32 into constant abutment with the piezoelectric actuator 2. The ball valve 34 is movable by the piston 32. The valve body 31 is illustrated as being made by a one-piece member, but can be actually formed by a plurality of blocks.

The fuel injector also includes a substantially cylindrical injector body 4 in which a cylindrical mount chamber 41 is formed; this mount chamber 41 extends along a longitudinal axial direction of the fuel injector. The mount chamber 41 has an inner shoulder to define a small-diameter housing (that is, an upper housing, as viewed in FIG. 1) in which the piezoelectric actuator 2 is mounted and a large-diameter housing (that is, a lower housing, as viewed in FIG. 1) in which the back-pressure control mechanism 3 is mounted. A hollow cylindrical retainer 5 is threaded in the injector body 4 to retain the nozzle 1 within the head of the injector body 4.

The nozzle body 12, the injector body 4, and the valve body 31 have formed therein a high-pressure passage 6 through which the high-pressurized fuel is delivered from the common rail. The injector body 4 and the valve body 31 have also formed therein a low-pressure passage 7 that communicates with a fuel tank (not shown). The nozzle body 12, the injector body 4, and the valve body 31 are made of metallic material and to be fit in a mount hole E3 formed in a cylinder head E2 of the internal combustion diesel engine. The injector body 4 is formed with an outer shoulder 42 with which an end of a clamp K is to engage for securing the fuel injector in the mount hole E3 tightly. Specifically, installation of the fuel injector in the mount hole E3 is achieved by fastening the other end of the clamp K to the cylinder head E2 through a bolt to press the outer shoulder 42 into the mount hole E3.

Between the outer periphery of a top portion of the needle 13 close to the spray hole 11 and the inner periphery of the needle body 12, a high-pressure chamber 15 is formed; this high-pressure chamber 15 communicates with the high-pressure passage 6 to constitute a part of the high-pressure passage 6. The high-pressure chamber 15 establishes a fluid communication with the spray hole 11 when the needle 13 is lifted up in a valve-opening direction. A back-pressure chamber 16 is formed by one of ends of the needle 13; this one of the ends of the needle 13 is opposite to the spray hole 11. The spring 14 is disposed within the back-pressure chamber 16 to bias the needle 13 in the valve-closing direction.

The valve body 31 has formed therein a high-pressure seat 35 exposed to a fluid passage extending between the high-pressure passage 6 and the back-pressure chamber 16 in the nozzle 1. The valve body 31 has also formed therein a low-pressure seat 36 exposed to a passage extending between the low-pressure passage 7 and the back-pressure chamber 16. The low-pressure seat 36 faces the high-pressure seat 35 to define a valve chamber within which the ball valve 34 is disposed.

The injector body 4 is formed with, as shown in FIG. 1, a high-pressure port 43 (i.e., a high-pressure pipe connector) to which a high-pressure pipe (not shown) is connected, and with a low-pressure port 44 (i.e., a low-pressure pipe connector) to which a low-pressure pipe (not shown) is connected.

The fuel injector of the first embodiment is designed such that the fuel supplied from the common rail is delivered to the high-pressure port 43 through the high-pressure pipe, in other words, the fuel enters the cylindrical injector body 4 from its outer circumferential wall. The fuel, as having entered the fuel injector, passes through the high-pressure passage 6 to flow into the high-pressure chamber 15 and the back-pressure chamber 16.

The injector body 43 is formed with a branch passage **6*a* that diverges from the high-pressure passage 6 toward one axial end of the injector body 4; this one axial end is opposite to the other axial end formed with the spray hole 11. The branch passage 6*a* is operative to guide the fuel in the high-pressure passage 6 to a fuel pressure sensor 50** described later.

The fuel injector includes a connector 60 attached to the one axial end of the injector body 4. The connector 60 has an actuator drive terminal (drive connector terminal) 62 to which external electric power is supplied; this drive connector terminal 62 is electrically connected to the piezoelectric actuator 2. The electrical power supplied to the drive connector terminal 62 is supplied to the piezoelectric actuator 2 via a lead terminal 21; this results in that the piezoelectric actuator 2 expands. The stop of the supply of the electrical power to the piezoelectric actuator 2 via the drive connector terminal 62 causes the piezoelectric actuator 2 to contract.

When the piezoelectric actuator 2 is in a contracted state, the valve 34 is, as illustrated in FIG. 1, urged into abutment with the low-pressure seat 36 to establish fluid communication between the back-pressure chamber 16 and the high-pressure passage 6 so that the high-pressure fuel is supplied to the back-pressure chamber 16. This results in that the pressure of the fuel in the back-pressure chamber 16 and the elastic pressure produced by the spring 14 act on the needle 13 to urge it in the valve-closing direction so as to close the spray hole 11.

Alternatively, when the electric power is applied to the piezoelectric actuator 2 so that the piezoelectric actuator 2 is in an expanded state, the valve 34 is pushed into abutment with the high-pressure seat 35 to establish fluid communication between the back-pressure chamber 16 and the low-pressure passage 7 so that the pressure of the fuel in the back-pressure chamber 16 drops. This pressure drop causes the needle 13 to be biased by the pressure of the fuel in the high-pressure chamber 15 in the valve-opening direction so as to open the spray hole 11. This spray-hole opening sprays the fuel into the combustion chamber E1 of a corresponding cylinder of the engine.

The spraying of the fuel from the spray hole 11 may result in a variation in pressure of the fuel in the high-pressure passage 6. In order to measure such a fuel-pressure variation, the fuel injector is provided with the fuel pressure sensor 50 installed in the injector body 4. For example, a computer circuit, such as an ECU (Electronic Control System) for control of the engine, is electrically connected to the fuel pressure sensor 50 via the connector 60 described later.

When receiving, from the fuel pressure sensor 50, a signal indicative of the measured fuel-pressure variation, the ECU analyses the waveform of the received signal to thereby find the timing when the pressure of the fuel began to drop due to the spraying of the fuel from the spray hole 11. Based on the timing, the ECU determines the actual injection start timing of the fuel injector. The ECU also analyses the waveform of the received signal to thereby find the timing when the pressure of the fuel began to rise due to the termination of the spraying of the fuel from the spray hole 11. Based on the timing, the ECU determines the actual injection end timing of the fuel injector, that is, a period for which the spray hole 11 has been kept opened since the actual injection start timing.

The ECU further calculates a maximum value of the amount of drop in pressure of the fuel to thereby determine the quantity of fuel actually sprayed from the fuel injector.

Next, the structure of the fuel pressure sensor 50 and the installation thereof in the injector body 4 will be described hereinafter with reference to FIGS. 1 and 2.

The fuel pressure sensor 50 is provided with, a stem (strain inducing member) 51 and a strain gauge (sensing element) 52.

The stem 51 works as a pressure deformable member that is sensitive to the pressure of the high-pressurized fuel in the branch passage 6*a* to elastically deform. The strain gauge 52 works to convert the elastic deformation or distortion of the stem 51 into an electric signal as a detected value of the pressure of the high-pressurized fuel in the high-pressure passage 6.

The stem 51 is made up of a hollow cylindrical body 51*b* and a circular plate-like diaphragm 51*c*.

The cylindrical body 51*b* is formed at its one axial end with a fuel inlet 51*a* into which the high-pressurized fuel from the branch passage 6*a* enters. The diaphragm 51*c* closes, at its one axial end surface, the other axial end of the cylindrical body 51*b*. The stem 51 is designed such that the inner wall surface of the cylindrical body 51*b* and the diaphragm 51*c* are subjected to the pressure of the high-pressurized fuel entering into the cylindrical body 51*b* from the fuel inlet 51*a* so that the whole of the stem 51 is deformed elastically.

The injector body 4 is provided with a mount chamber 45 formed as a cylindrical recess in the one axial end thereof; this one axial end is opposite to the other axial end formed with the spray hole 11. The cylindrical body 51*b* of the stem 51 is coaxially fitted in the mount chamber 45. The mount chamber 45 is formed at its inner circumferential surface with an internal thread. The cylindrical body 51*b* is formed at the outer circumferential surface of its substantially one axial half part with an external thread 51*d*; this one axial half part of the cylindrical body 51*b* is to be installed in the mount chamber 45 of the injector body 4 and has a diameter greater than that of the remaining axial half part of the cylindrical body 51*b*.

The installation of the stem 51 in the injector body 4 is achieved by inserting the stem 51 into the mount chamber 45 from the outside of the injector body 4 in the axial direction of the injector body 4 so as to engage the external thread 51*d* of the cylindrical body 51*b* with the internal thread of the mount chamber 45.

The strain gauge 52 is attached to the diaphragm 51*c*. Specifically, the strain gauge 52 is mounted on the other axial end surface of the diaphragm 51*c*; the other axial end surface is opposite to the one axial end surface of the diaphragm 51*c*. The strain gauge 52 mounted on the other axial end surface of the diaphragm 51*c* is encapsulated by a glass member 52*b* so as to be fixed thereon. When the stem 51 elastically expands according to the pressure of the high-pressurized fuel entering into the cylindrical body 51*b*, the diaphragm 51*c* is distorted. The strain gauge 52 detects the amount of distortion (elastic deformation) of the diaphragm 51*c*.

A metal plate 53 having, for example, a substantially circular shape with a central hole is mounted on the stem 51 such that the other axial half part of the cylindrical body 51*b* is fitted in the central hole of the plate 53 to project therefrom. On the plate 53, a mold IC (mold member) 54 and a bobbin (wire holder) 55, described in detail later, are fixedly mounted.

Figure 3A:
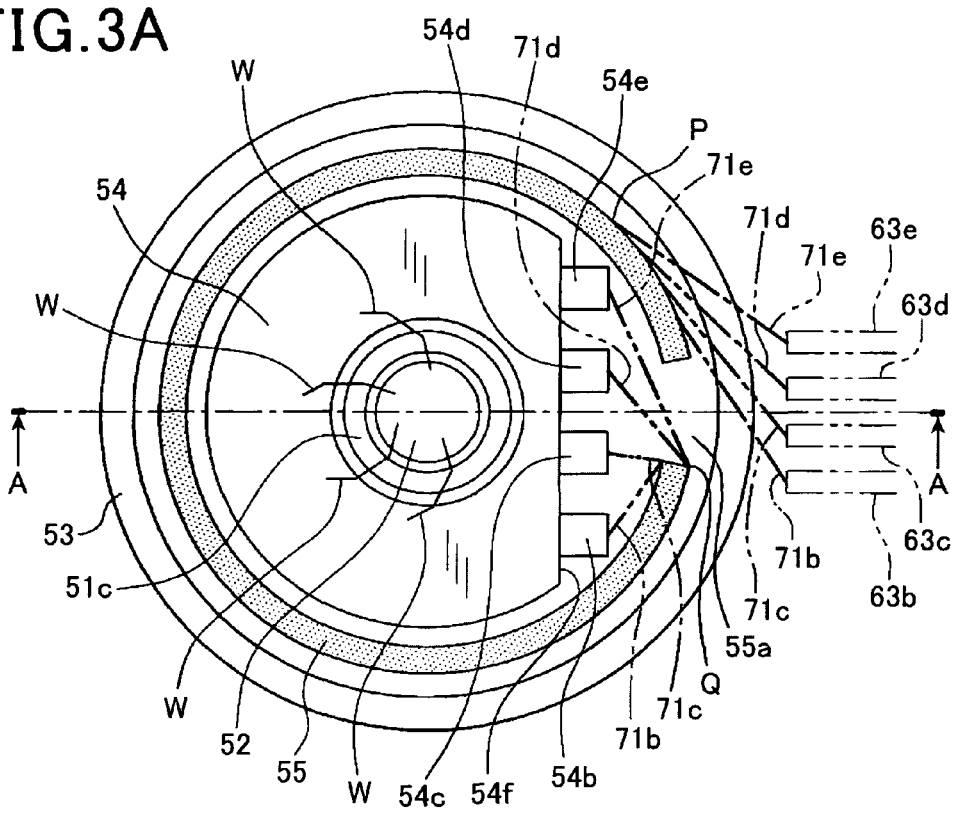
FIG. 3A is a plan view that shows an arrangement of a plurality of electrodes of a sensor assembly containing a fuel pressure sensor of the fuel injector according to the first embodiment.
Figure 3B:
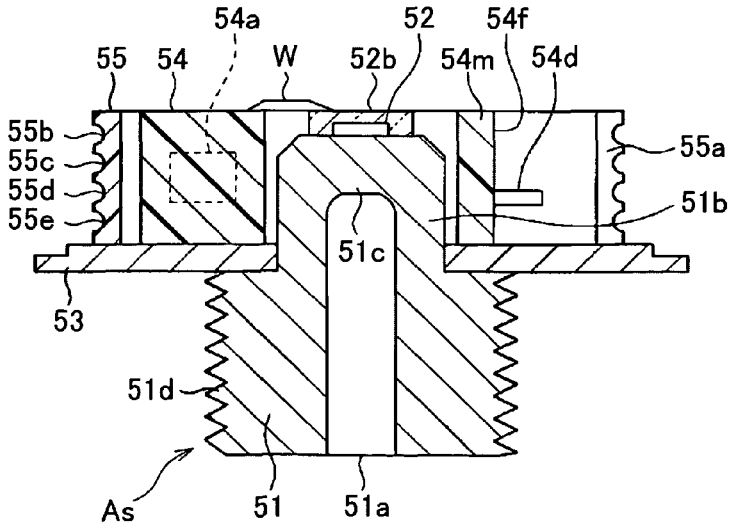
FIG. 3B is a partial cross sectional view of the sensor assembly illustrated in FIG. 3A taken on line A-A therein.

Note that the cylindrical body 51*b* of the stem 51 and the mold IC 54 are arranged with a clearance therebetween, and the mold IC 54 and the bobbin 55 are arranged with a clearance therebetween. FIG. 3A schematically illustrates one end surface of a sensor assembly As of the fuel injector according to the first embodiment; this sensor assembly As is constructed by integrally assembling the fuel pressure sensor 50, the plate 53, the mold IC 54, and the bobbin 55 to each other. The one end surface of the sensor assembly As is opposite to the other end thereof close to the injector body 4. FIG. 3B schematically illustrates a partial cross sectional view of the sensor assembly As taken on line A-A in FIG. 3A. Note that, in FIG. 3A, a dot-hatched portion represents the bobbin 55.

The mold IC 54 is made up of circuit components 54*a*, sensor terminals 54*b*, 54*c*, 54*d*, and 54*e* (see FIG. 3A), and a resin mold package 54*m*. The circuit components 54*a* include a voltage applying circuit, an amplifier, and a filter, and electrically connected to the sensor terminals 54*b*, 54*c*, 54*d*, and 54*e*. The voltage amplifying circuit and the amplifier are electrically connected to the stain gauge 52 through wires W using, for example, wire-bonding techniques. The voltage amplifying circuit is operative to amply a voltage to the stain gauge 52 that constitutes a resistance bridge circuit. When the diaphragm 51*c* is elastically deformed, an output voltage of the resistance bridge circuit is changed depending on the elastic deformation of the diaphragm 51*c* so that the output voltage indicative of the change in the elastic deformation of the diaphragm 51*c* is transferred to the amplifier of the mold IC 54 as a detected value of the pressure of the high-pressurized fuel in the high-pressure passage 6. The output voltage of the resistance bridge circuit is amplified by the amplifier so as to be outputted, as a detected signal of the fuel pressure sensor 50, from one of the sensor terminals 54*b*, 54*c*, 54*d*, and 54*e*.

The resin mold package 54*m* has a substantially annular shape coaxially arranged around the other axial half part of the cylindrical body 51*b*, and is so placed on the plate 53 as to encapsulate the circuit components 54*a* and the sensor terminals 54*b*, 54*c*, 54*d*, and 54*e*. The resin mold package 54*m* has a circumferential sidewall, a part of which is formed with a plane surface 54*f* extending in orthogonal to a radial line passing through the axial direction of the stem 51 and in parallel to the axial direction thereof. The sensor terminals 54*b* to 54*e* project outwardly from the plane surface 54*f* of the mold package 54*m*, and work as a terminal for outputting the detected signal of the fuel pressure sensor 50, a terminal for supplying the voltage to the voltage applying circuit, a ground terminal, and so on.

The sensor terminals 54*b*, 54*c*, 54*d*, and 54*e* are arranged to be flush with each other in the axial direction of the stem 51.

The connector 60 has a housing 61 attached to the one end of the injector body 4 such that part of the housing 61 projects in a radial direction of the injector body 4 to form, for example, a connector jack.

The connector 60 includes connector terminals 63*b*, 63*c*, 63*d*, and so 63*e*. The connector terminals 63*b*, 63*c*, 63*d*, and 63*e* are held in the connector housing 61 together with the drive connector terminal 62.

Figure 2:
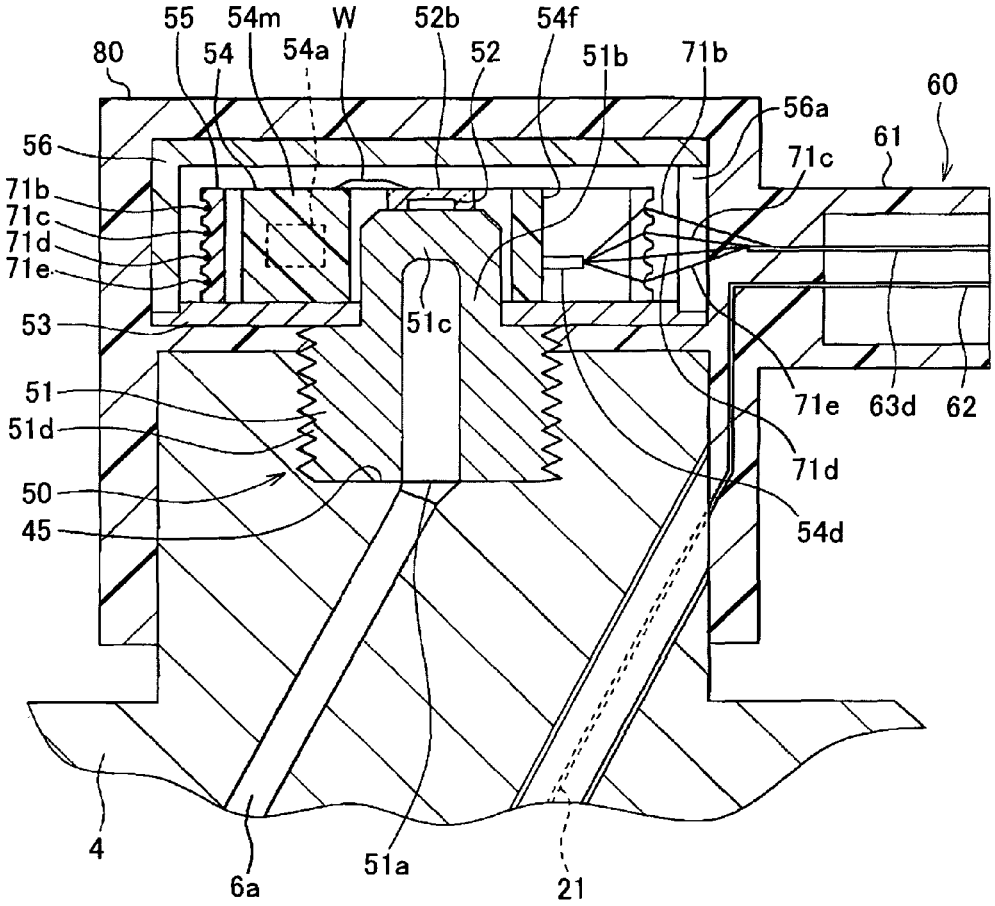
FIG. 2 is a partially enlarged view of FIG. 2.

The connector terminals 63*b*, 63*c*, 63*d*, and 63*e* extend linearly in a direction orthogonal to the axial direction of the injector body 4 along the connector jack; this direction corresponds to a horizontal direction in FIG. 2. Similarly, the drive connector terminal 62 extends linearly in a direction parallel to the extending direction of each of the connector terminals 63*b* to 63*c*. The connecter terminals 63*b*, 63*c*, 63*d*, and 63*e* are arranged to be flush with each other in the axial direction of the injector body 4.

For example, to the connector jack of the connector 60, a connector for external harnesses electrically connected to external circuits, such as the computer circuit (ECU) and the like, is joined to be electrically connected to the connecter terminals 63*b*, 63*c*, 63*d*, and 63*e* and the drive connector terminal 62.

The fuel injector includes a substantially hollow cylindrical, resin-mold housing 80 with one opening end, one closed end opposite thereto, and a circumferential sidewall joining them. Part of the sidewall is integrally joined to the housing 61 of the connector 60.

The housing 80 includes a partition wall PW having a central through hole; this partition wall PW defines a storage chamber among the partition wall PW, the closed end, and the sidewall. The opening end and the sidewall define a hollow cylindrical holder. The one end of the injector body 4 is fitted in the holder such that the other axial half part of the cylindrical body 51*b* is fitted in the central hole of the holder to project therefrom to be stored in the storage chamber.

The fuel injector includes wires 71*b*, 71*c*, 71*d*, and 71*e*. The connecter terminals 63*b*, 63*c*, 63*d*, and 63*e* are electrically connected to the sensor terminals 54*b*, 54*c*, 54*d*, and 54*e* via the wires 71*b*, 71*c*, 71*d*, and 71*e*, respectively. In the first embodiment, the wires 71*b*, 71*c*, 71*d*, and 71*e* are electrically connected to the connecter terminals 63*b*, 63*c*, 63*d*, and 63*e* and to the sensor terminals 54*b*, 54*c*, 54*d*, and 54*e* by laser welding, but these connections can be implemented by another method, such as soldering, fusing welding, resistance welding, or the like. As each of the wires 71*b* to 71*e*, an insulator coated lead wire or a bare wire can be used.

The bobbin 55 has a substantially circular-arc shape and is made of a resin. The bobbin 55 is coaxially placed on the plate 53 so as to surround the resin mold package 54*m*, around which the wires 71*b* to 71*e* are wound to be latched. That is, the wires 71*b* to 71*e* are held by the bobbin 55 around the fuel pressure sensor 50.

Figure 4A:
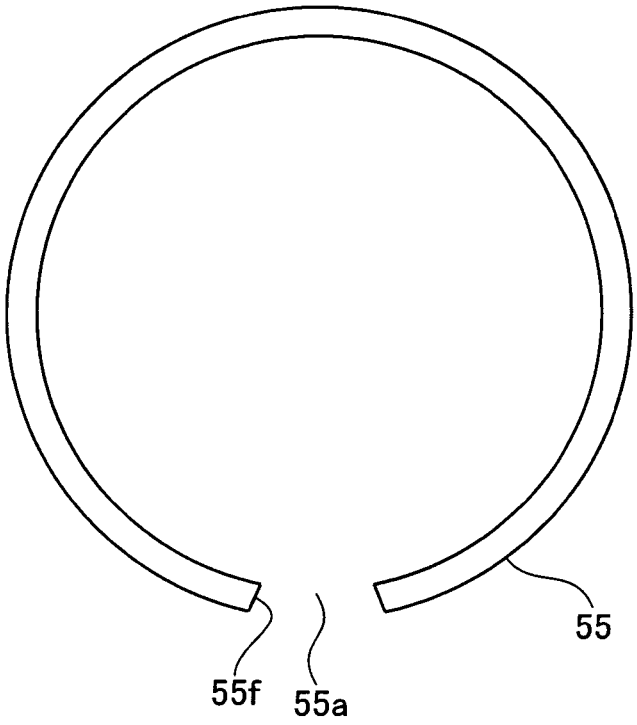
FIG. 4A is a plan view of a bobbin illustrated in FIGS. 3A and 3B according to the first embodiment.
Figure 4B:
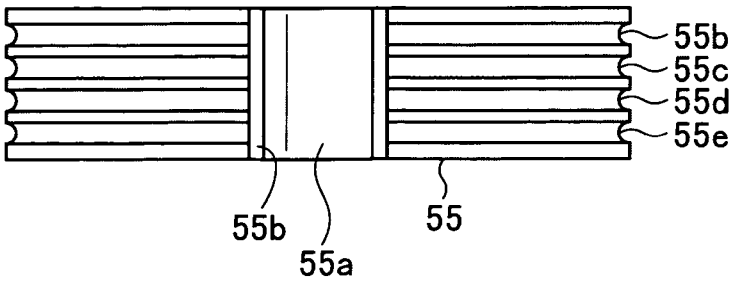
FIG. 4B is a side view of the bobbin illustrated in FIGS. 3A and 3B according to the first embodiment.

Specifically, as illustrated in FIGS. 3, 4A, and 4B, the bobbin 55 is comprised of a circular-arc peripheral wall that extends along the outer circumference of the resin mold package 54*m*. The bobbin 55 includes an opening 55*a* defined by both ends of the peripheral wall, which faces is the plane surface 54*f* of the resin mold package 54*m*. A top end of the bobbin 55 is located to be flush with a top end of the mold IC 54 and a top end of the strain gauge 52 in the axial direction of the stem 51.

The bobbin 55 is formed at its outer surface of the peripheral wall with a plurality of grooves 55*b*, 55*c*, 35*d*, and 55*e* extending along a circumferential direction of the peripheral wall. The grooves 55*b*, 55*c*, 55*d*, and 55*e* are separately aligned in the axial direction of the peripheral wall corresponding to the axial direction of the stem 51. The wires 71*b* to 71*e* are fitted in the grooves 55*b* to 55*e*, respectively, so that the wires 71*b* to 71*e* are located at their predetermined positions on the outer circumference of the peripheral wall. Because the grooves 55*b*, 55*c*, 55*d*, and 55*e* are separately aligned in the axial direction of the peripheral wall in this order from the top of the bobbin 55 toward the plate 53, the wires 71*b*, 71*c*, 71*d*, and 71*e* are fixedly held by the bobbin 55 without being in contact with each other.

Note that the positions of the connector terminals 63*b* to 63*e* and the sensor terminals 54*b* to 54*e* in the axial direction of the stem 51 are preferably lower than the topmost groove 55*b* and higher the lowermost groove 55*e*. More preferably, the connector terminals 63*b* to 63*e* and the sensor terminals 54*b* to 54*e* are flush with a center height of the bobbin 55 in the axial direction of the stem 51 relative to the plate 53.

A substantially hollow cylindrical metal case 56 is mounted at its one end surface on the outer periphery of the plate 53. Most of the other axial half part of the cylindrical body 51*b*, the diaphragm 51*c*, the strain gauge 52, the mold IC 54, and the bobbin 55 are contained in a housing formed by the metal plate 53 and the metal case 56. The housing 53 and 56 blocks external noise to protect the strain gauge 52 and the mold IC 54 therefrom. The metal case 56 is formed at its circumferential sidewall with a window 55*a* located to face the opening 55*a* and communicating with the inside of the metal case 56. The wires 71*b* to 71*e* outwardly extend from the inside of the metal case 56 through the window 56*a*.

While the metal case 56 and the meta plate 53 are attached to the injector body 4 via the fuel pressure sensor 50, the metal plate 56 and the metal plate 53 are molded together with the connector jack 61 so that the housing 80 is formed to encapsulate the fuel pressure sensor 50, the metal plate 56, and the metal plate 53.

Next, the procedure to install the sensor assembly As in the injector body 4 and the procedure to electrically connect each of the sensor terminals 54*b* to 54*e* to a corresponding one of the connector terminals 63*b* to 63*e* via a corresponding one of the wires 71*b* to 71*e* will be described hereinafter.

First, the sensor assembly As illustrated in FIG. 3A is assembled.

Specifically, the plate 53 is coaxially mounted on the stem 51 to which the strain gauge 52 has been attached, so that the other axial half part of the cylindrical body 51*b* is fitted in the central hole of the plate 53 to project therefrom. The mold IC 54 and the bobbin SS are coaxially placed on the plate 53. Thereafter, the circuit components 54*a* of the mold IC 54 and the strain gauge 52 are electrically connected to each ether through the wires W by a prepared bonding machine using wire-bonding techniques.

Next, the sensor assembly As is installed in the injector body 4. Specifically, the stem 51 of the sensor assembly As is inserted into the mount chamber 45 from the outside of the injector body 4 in the axial direction thereof while being rotated about its axial direction. This results in that the external thread 51*d* is meshed with the internal thread of the mount chamber 45 (assembly installation step). In addition, the housing 61 of the connector 60 that supports the connector terminals 62 and 63*a* to 63*e* is attached to the one end of the injector body 4 such that the connector terminals 63*a* to 63*e* radially extend and face the center of the bobbin 55 in the axial direction of the stem 31.

Thereafter, the drive connector terminal 62 and the lead electrode 21 are electrically connected to each other. In addition, each of the connector terminals 63*b* to 63*e* is electrically connected to a corresponding one of the wires 71*b* to 71*e* using, for example, a wiring machine and a welding machine.

Specifically, one ends of the wires 71*b* to 71*e* are located on the sensor terminals 54*b* to 54*e*, respectively, by movement of a wire supplying nozzle of the wiring machine.

For example, the nozzle of the wiring machine is moved from the outside of the bobbin 55 into the inside thereof through the opening 55*a* so that one end of each of the wires 71*b* is located on a corresponding one of the sensor terminals 54*b* to 54*e*. The one end of each of the wires 71*b* to 71*e* is welded to a corresponding one of the sensor terminals 54*b* to 54*e* by the welding machine.

Thereafter, the nozzle of the wiring machine is moved along a preset route while the one end of each of the wires 71*b* to 71*e* is welded to a corresponding one of the sensor terminals 54*b* to 5*e* so that each of the wires 71*b* to 71*e* is wound around a corresponding one of the grooves 55*b* to 55*e* of the bobbin 55.

Specifically, the nozzle is moved out of the bobbin 55 through the opening 55*a*, and moved along each of the grooves 55*b* to 55*e* so that each of the wires 71*b* to 71*e* is wound around a corresponding one of the grooves 55*b* to 55*e*. Thus, a first connection step is completed.

Thereafter, the nozzle is moved up to each of the connectors 63*b* to 63*e* so that the other end of each of the wires 71*b* to 71*e* is located on a corresponding one of the connectors 63*b* to 63*e*. Next, the other end of each of the wires 71*b* to 71*e* is welded to a corresponding one of the connector terminals 63*b* to 63*e* by the welding machine. Thus, a second connection step is completed.

Because the nozzle is controlled to be moved while a proper tension is applied to each of the wires 71*b* to 71*e*, when the welding of other end of each of the wires 71*b* to 71*e* is completed, the wires 71*b* to 71*e* are subjected to a proper tension.

Next, the case 56 is mounted on the outer periphery of the plate 53 such that the wires 71*b* to 71*e* are located through the opening 56*a* of the case 56.

Thereafter the mount, the case 56, the plate 53, the wires 71*b* to 71*e*, and the connector 60 are molded from resin so that the resin-mold housing 80 is formed to cover the case 56 (sensor assembly As), the wires 71*b* to 71*e*, and the connector terminals 63*b* to 63*e*.

As a result, the installation of the sensor assembly As and the like in the injector body 4 and the internal electrical connections in the fuel injector are completed.

As described above, in order to produce a plurality of the fuel injectors according to the first embodiment, the sensor assembly As is screwed into the injector body 4 of each of the fuel injectors. At the moment when the screwing of the stem 51 into the injector body 4 of each fuel injector is completed, rotational positions of the sensor terminals 54*b* to 54*e* of each fuel pressure sensor may be different from those of the sensor terminals 54*b* to 54*e* of another one fuel pressure sensor.

Figure 5A:
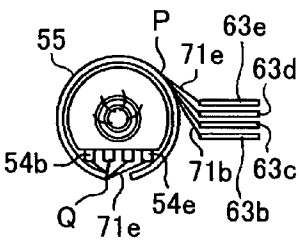
FIGS. 5A to 5F are longitudinal sectional views of the internal structures of the fuel injectors according to the first embodiment of the present invention; these views represent the differences of the rotational positions of their sensor assemblies when the screwing of the sensor assemblies are completed.
Figure 5C:
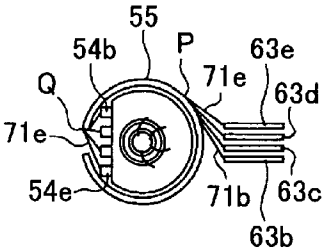
Figure 5E:
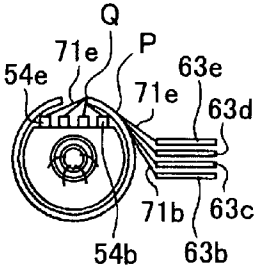
Figure 5B:
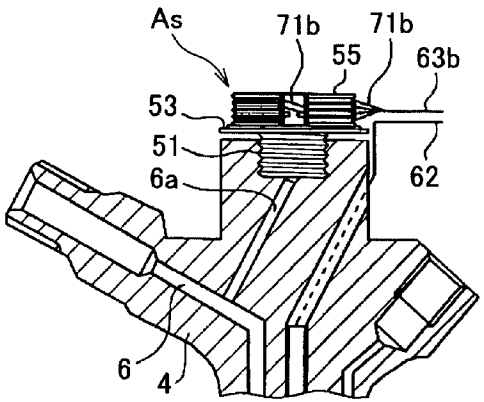
Figure 5D:
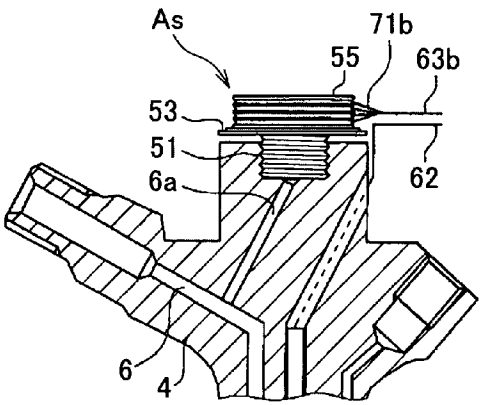
Figure 5F:
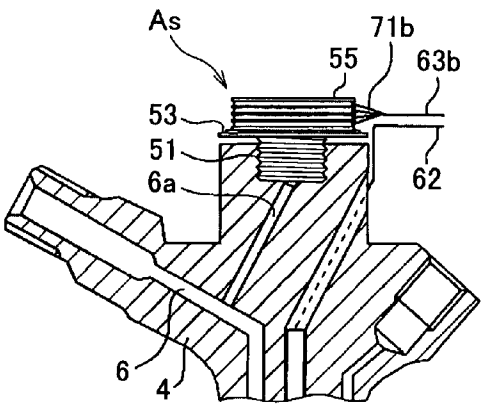

Specifically, in one of the fuel injectors according to the first embodiment, the sensor terminals 54*b* to 54*e* may be located to be directed as illustrated in FIG. 3A, and in another one of the fuel injectors according to the first embodiment, the sensor terminals 54*b* to 54*e* may be located to be directed as illustrated in FIGS. 5A and 5B. In another one of the fuel injectors according to the first embodiment, the sensor terminals 54*b* to 54*e* may be located to be directed as illustrated in FIGS. 5C and 5D, and in another one of the fuel injectors according to the first embodiment, the sensor terminals 54*b* to 54*e* may be located to be directed as illustrated in FIGS. 5E and 5F.

In order to address such a drawback, in each the fuel injectors according to the first embodiment, the wires 71*b* to 71*e* are wound around the bobbin 55 located around the mold package 54*m*. The configuration locates an end portion P of each of the wires 71*b* to 71*e* at a fixed position around the fuel pressure sensor 50 at the moment when the winding (engagement) of a corresponding wire around the bobbin 55 is completed.

Thus, the wiring route between the end portion P of each of the wires 71*b* to 71*e* and a corresponding one of the connector terminals 63*b* to 63*e* remains constant independently of the rotational positions of the sensor terminals 54*a* to 54*e*.

This advantage makes it possible to easily prevent adjacent ones of the wires 71*b* to 71*e* from being interfered with each other. Note that the end portion P of each of the wires 71*b* to 71*e* and a corresponding one of the connector terminals 63*b* to 63*e* is fixedly located between a corresponding one of the sensor terminals 54*b* to 54*e* and a corresponding one of the connector terminals 63*b* to 63*e* irrespective of the rotational positions of the sensor terminals 54*b* to 54*e*.

The fuel injector according to the first embodiment also achieves the following benefits.

Specifically, the peripheral wall of the bobbin 56 is shaped to extend in a circular arc along a direction in which each of the wires 71*b* to 71*e* is wound. Thus, in comparison to a bobbin whose peripheral wall has a substantially polygonal shape along a direction in which each of the wires 71*b* to 71*e* is wound (see FIGS. 6A and 6B), it is possible to reduce the concentration of stresses from the bobbin 55 to the wires 71*b* to 71*e*, thus reducing the risk of damage of the wires 71*b* to 71*e* due to friction with the bobbin 55.

Because the bobbin 55 and the fuel pressure sensor 50 are assembled into the sensor assembly As, when the stem 51 is threadedly installed into the injector body 4, the bobbin 55 is rotated with the stem 51. The bobbin 55 has the opening 55*a* defined by both ends of the peripheral wall, which faces the plane surface 54*f* of the resin mold package 54*m*, that is, faces the sensor terminals 54*b* to 54*e*. The winding of each of the wires 71*b* to 71*e* is started from one end 55*f* of the peripheral wall of the bobbin 55 (see FIG. 4A).

For this reason, the wiring route between a start portion Q (see FIGS. 3A, 3B, and 5A to 5F) of each of the wires 71*b* to 71*e* from which the winding (engagement) of a corresponding wire around the bobbin 55 is started and a corresponding one of the sensor terminals 54*b* to 54*e* remains constant independently of the rotational positions of the sensor terminals 54*a* to 54*e*. Thus, it is possible to reliably prevent adjacent ones of the wires 71*b* to 71*e* from being interfered with each other.

As described above, the bobbin 55 has the opening 55*a* defined by both ends of the peripheral wall, and the winding of each of the wires 71*b* to 71*e* is started from the one end 55*f* of the peripheral wall of the bobbin 55. For this reason, each of the wires 71*b* to 71*e* subjected to a proper tension is brought to be pressed onto the one end 55*f* of the peripheral wall of the bobbin 55. Thus, it is possible to prevent the start portion Q of each of the wires 71*b* to 71*d* from being removed from the bobbin 55.

The bobbin 55 is formed at its outer surface of the peripheral wall with the grooves 55*b*, 55*c*, 55*d*, and 55*e* extending along a circumferential direction of the peripheral wall. The grooves 55*b*, 55*c*, 55*d*, and 55*e* are separately aligned in the axial direction of the peripheral wall corresponding to the axial direction of the stem 51. The wires 71*b* to 71*e* are wound to be fitted in the grooves 55*b* to 55*e*, respectively, so that the wires 71*b* to 71*e* are located at their predetermined positions on the outer circumference of the peripheral wall in its axial direction.

For this reason, it is possible to reliably prevent axially adjacent portions of the wires 71*b* to 71*e* from being interfered with each other. This benefit can utilize a bare wire as each of the wires 71*b* to 71*e*. When an insulator coated wire is used as each of the wires 71*b* to 71*e*, it is possible to prevent axially adjacent portions of the wires 71*b* to 71*e* from being short-circuited in the event that the axially adjacent portions are in contact with each other.

The drive connector terminal 62 and the connector terminals 63*b* to 63*e* are held to the same connector housing 61 so that the connector terminals 62 and 63*b* to 63*e* are designed as the single connector (single connector jack) 60. For this reason, the fuel pressure sensor 50 is installed in the fuel injector without increasing the number of connectors. This configuration of the fuel injector allows harnesses for electrically connecting the connector 60 and external circuits to be collectively brought out from the connector 60. Thus, it is possible to simplify the arrangement of the harnesses, and save time and human power required to connect the harnesses to the connector terminals 62 and 63*b* to 63*e*.

Second Embodiment

A fuel injector according to the second embodiment of the present invention will be described hereinafter with reference to FIGS. 6A and 6B.

The structure of the fuel injector according to the second embodiment is substantially identical to that of the fuel injector according to the first embodiment except for the following points. So, like parts between the fuel injectors according to the first and second embodiments, to which like reference characters are assigned, are omitted or simplified in description.

The fuel injector according to the first embodiment is configured such that the peripheral wall of the bobbin 55 is shaped to extend in a circular arc along a direction in which each of the wires 71*b* to 71*e* is wound; this direction corresponds to the rotational direction of the fuel pressure 50.

Figure 6A:
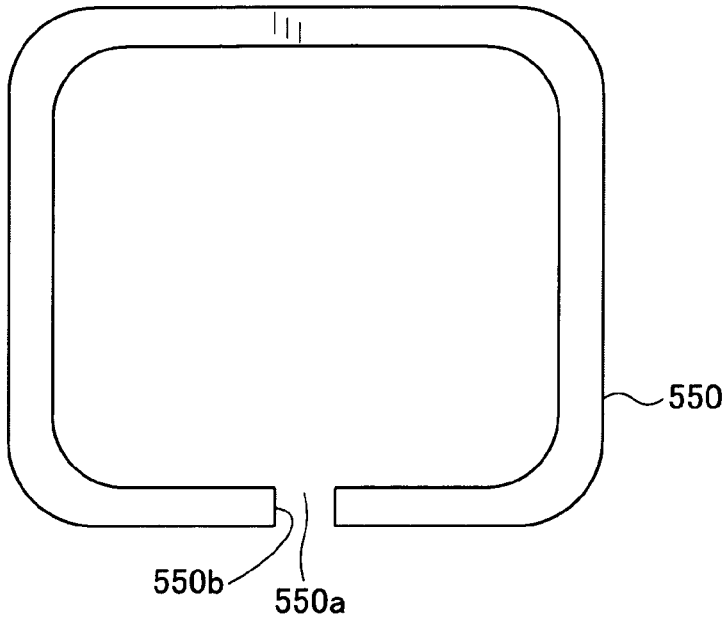
FIG. 6A is a plan view of a bobbin according to the second embodiment.
Figure 6B:
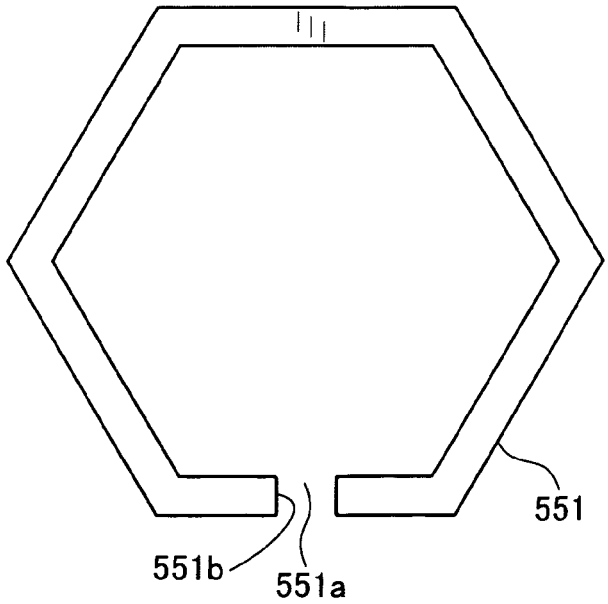
FIG. 6B is a plan view of a bobbin according to the second embodiment.

In contrast, the fuel injector according to the second embodiment is configured such that the peripheral wall of a bobbin 550 or 551 has a substantially polygonal shape along a direction in which each of the wires 71*b* to 71*e* is wound (see FIGS. 6A and 6B).

For example, as illustrated in FIG. 6A, the peripheral wall of the bobbin 550 can have a substantially rectangular shape as viewed from one axial end of the fuel injector. As another example, as illustrated in FIG. 6B, the peripheral wall of the bobbin 551 can have a substantially hexagonal shape as viewed from one axial end of the fuel injector. In addition, the peripheral wall of the bobbin 551 can have a substantially polygonal shape as viewed from one axial end of the fuel injector; the number of sides of the polygonal shape is greater than six.

In the second embodiment, the bobbin 550 or 551 includes an opening 550*a* or 551*a* defined by both ends of the corresponding peripheral wall, which faces the plane surface 54*f* of the resin mold package 54*m*. The bobbin 550 or 551 is preferably formed at its outer surface of the peripheral wall with a plurality of grooves (not shown), like the grooves 55*b*, 55*c*, 55*d*, and 55*e*, which extend along a circumferential direction of the peripheral wall.

Third Embodiment

A fuel injector according to the third embodiment of the present invention will be described hereinafter with reference to FIGS. 7A and 7B.

The structure of the fuel injector according to the third embodiment is substantially identical to that of the fuel injector according to the first embodiment except for the following points. So, like parts between the fuel injectors according to the first and third embodiments, to which like reference characters are assigned, are omitted or simplified in description.

The fuel injector according to the first embodiment is configured such that the wire holder (bobbin) 55 has a circular arc shape that extends in a direction in which each of the wires 71*b* to 71*e* is wound, so that each of the wires 71*b* to 71*e* and the wire holder (bobbin) 55 establish line contact therebetween.

Figure 7A:
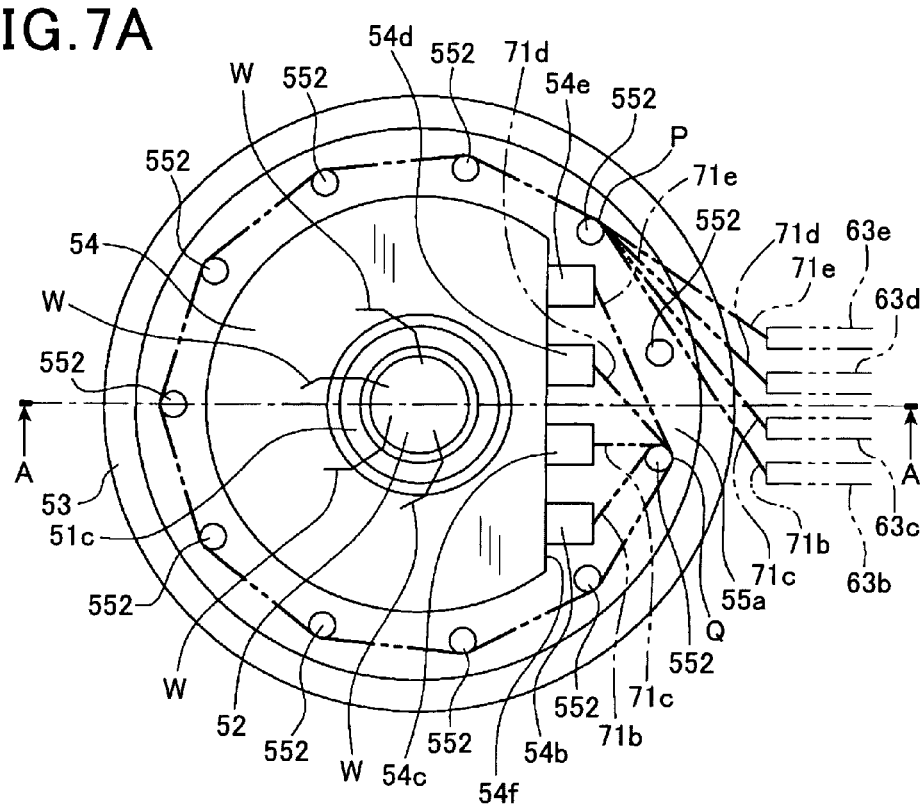
FIG. 7A is a plan view that shows an arrangement of a plurality of electrodes of a sensor assembly containing a fuel pressure sensor of the fuel injector according to the third embodiment.
Figure 7B:
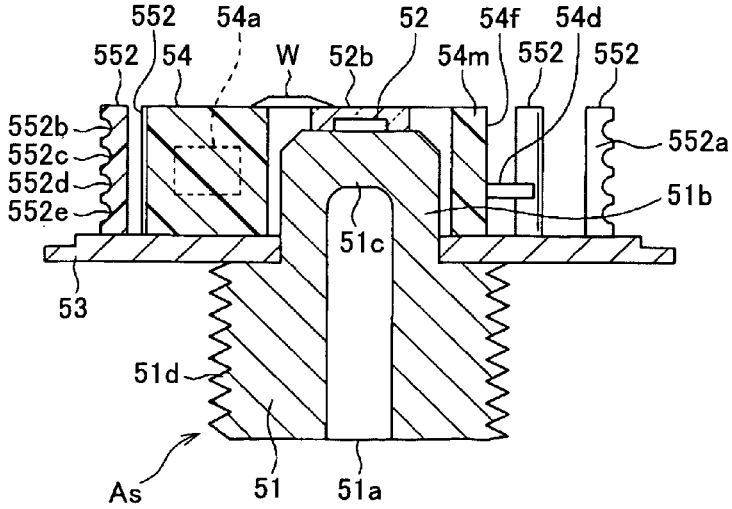
FIG. 7B is a partial cross sectional view of the sensor assembly illustrated in FIG. 7A taken on line A-A therein.

In contrast, the fuel injector according to the third embodiment illustrated in FIGS. 7A and 7B is configured such that a wire holder consists of a plurality of pins 552 each having a substantially cylindrical shape. The plurality of pins 552 are arranged at regular intervals on the plate 53 so as to be aligned in a direction in which each of the wires 71*b* to 71*e* is wound; this direction corresponds to the rotational direction of the sensor assembly As. The plurality of pins 552 surround the resin mold package 54*m*. The configuration of the plurality of pins 552 brings each of the plurality of pins 552 to be in point contact with each of the wires 72*b* to 72*e*.

The plurality of pins 552 has a space 552*a* that is located to face the plane surface 54*f* of the resin mold package 54*m*. Each of the plurality of pins 552 is formed at a part of its outer surface with a plurality of grooves 552*b*, 552*c*, 552*d*, and 552*e*, which extend along the arrangement direction of the plurality of pins 552.

In the third embodiment, each of the grooves 552*b* to 552*c* is formed in a part of the outer surface of each of the plurality of pins 552; this part is in contact with a corresponding one of the wires 72*b* to 72*e*.

That is, a virtual annular plane is defined around the sensing element (strain gauge) 52 such that each of the plurality of pins 552 circumscribes at a part of its outer surface the virtual annular plane. At that time, the grooves 552*b* to 552*e* are so formed in the part of the outer surface of each of the plurality of pins 552 as to be separately aligned in the axial direction of the virtual annular plane.

The fuel injector according to the third embodiment simplifies the configuration of the wire holder in comparison to the configuration of the bobbin 55 according to the first embodiment. Because the grooves 552*b* to 552*e* are formed in the part of the outer surface of each of the plurality of pins 552, it is possible to ensure the strength of each of the plurality of pins 552. Note that the grooves 552*b* to 552*e* can be entirely formed in the outer surface of each of the plurality of pins 552 as long as a required strength of each of the plurality of pins 552 is ensured.

Fourth Embodiment

Figure 8A:
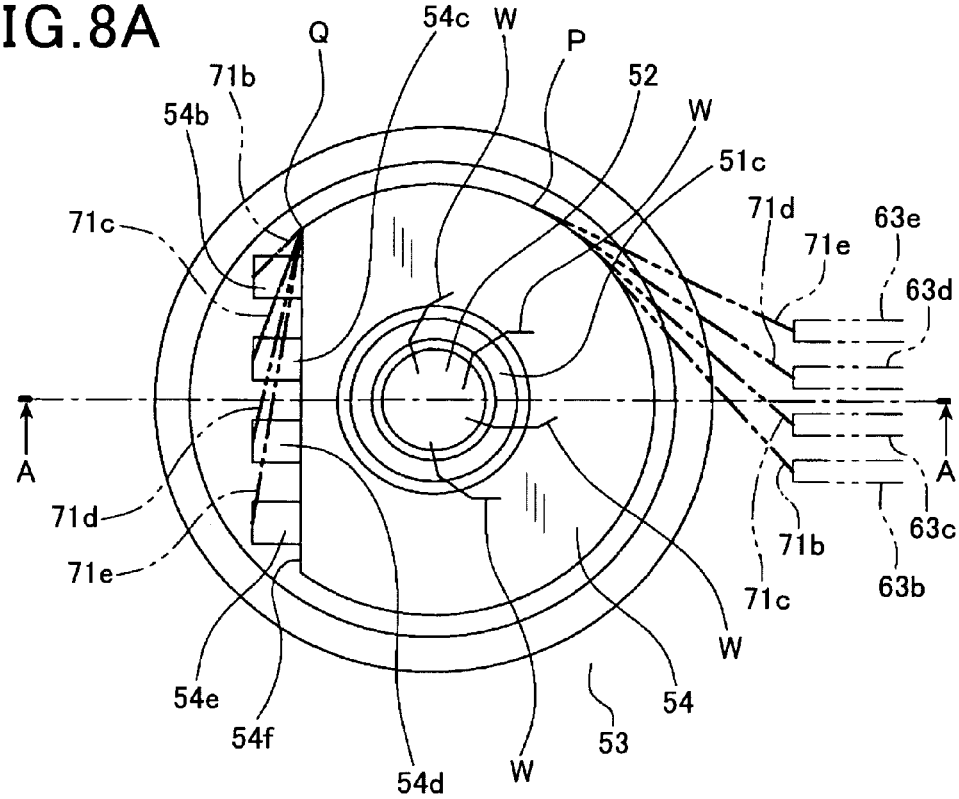
FIG. 8A is a plan view that shows an arrangement of a plurality of electrodes of a sensor assembly containing a fuel pressure sensor of the fuel injector according to the fourth embodiment.
Figure 8B:
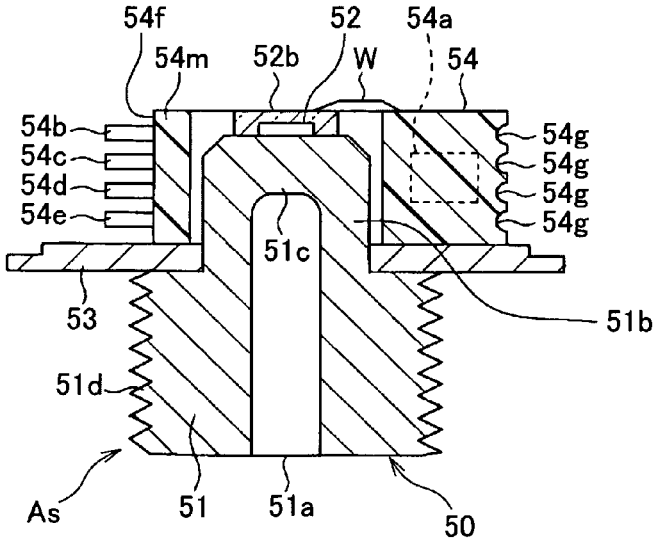
FIG. 8B is a partial cross sectional view of the sensor assembly illustrated in FIG. 8A taken on line A-A therein.

A fuel injector according to the fourth embodiment of the present invention will be described hereinafter with reference to FIGS. 8A and 8B.

The structure of the fuel injector according to the fourth embodiment is substantially identical to that of the fuel injector according to the first embodiment except for the following points. So, like parts between the fuel injectors according to the first and fourth embodiments, to which like reference characters are assigned, are omitted or simplified in description.

In the fuel injector according to the fourth embodiment, the bobbin 55 is eliminated in comparison to the configuration of the fuel injector according to the first embodiment.

Specifically, the fuel injector according to the fourth embodiment is configured such that the annular outer surface of the circumferential sidewall of the resin mold package 54*m* of the resin mold IC 54 is formed with a plurality of grooves 55*g* extending along a circumferential direction of the circumferential sidewall. The grooves 55*g* are separately aligned in the axial direction of the circumferential sidewall corresponding to the axial direction of the stem 51. The wires 71*b* to 71*e* are wound to be fitted in the grooves 55*g*, respectively, so that the wires 71*b* to 71*e* are located at their predetermined positions on the annular outer surface of the circumferential sidewall. Because the grooves 55*g* are separately aligned in the axial direction of the circumferential side wall in this order from the top of the resin mold package 54*m* toward the plate 58, the wires 71*b*, 71*c*, 71*d*, and 71*e* are fixedly held by the resin mold package 54*m* without being in contact with each other.

The configuration of the fuel injector allows the resin mold package 54*m* of the mold IC 54 to be shared as the package of the circuit component 54*a* and the like and as the wire holder around which the wires 71*b* to 71*e* are engaged.

Thus, in comparison to the configuration that requires a specific wire holder, it is possible to reduce the fuel injector in size in its radial directions.

In the first embodiment, the plurality of sensor terminals 54*a* to 54*e* are arranged to be flush with each other in the axial direction of the stem 51. In contrast, in the fourth embodiment, the plurality of sensor terminals 54*a* to 54*e* are arranged at different positions in the axial direction of the stein 51. The position of each of the plurality of sensor terminals 54*a* to 54*e* in the axial direction of the stem 51 is aligned with a corresponding one of the grooves 55*g*.

The configuration of the fuel injector prevents adjacent ones of the wires 71*b* to 71*e* from being interfered with each other within the wiring routes between the start portions Q of the wires 71*b* to 71*e* and the sensor terminals 54*b* to 54*e*.

The present invention is not limited to the first to fourth embodiments, and therefore, the first to fourth embodiments can be modified as follows, or the subject matters of the respective first to fourth embodiments can be combined with one another.

In each of the first to fourth embodiments, in order to join (weld) the wires 71*b* to 71*e* to the sensor terminals 54*b* to 54*e* and to the connector terminals 63*b* to 63*e*, first, the wires 71*b* to 71*e* are joined to the sensor terminals 54*b* to 54*e*, respectively. Next, the wires 71*b* to 71*e* are wound around the wire holder 55 (550, 551, or 552) to be engaged therewith. Thereafter, the connecter terminals 63*b* to 63*e* are joined to the wires 71*b* to 71*e*, respectively. However, the present invention is not limited to the procedure.

Specifically, first, the wires 71*b* to 71*e* can be joined to the connector terminals 63*b* to 54*e*, respectively. Next, the wires 71*b* to 71*e* can be wound around the wire holder 55 (550, 551, or 552) to be engaged therewith. Thereafter, the sensor terminals 54*b* to 54*e* can be joined to the wires 71*b* to 71*e*, respectively.

In other words, the direction in which the wires 71*b* to 71*e* are wound can be directed to the connector terminals 63*b* to 63*e*, and to the sensor terminals 54*b* to 54*e*. In the latter procedure, the end portions P of the wires 71*b* to 71*e* are replaced with the start portions P.

In each of the first to fourth embodiments, the present invention is applied to the injector configured such that the high-pressure port 43 is formed at the outer peripheral portion of the injector body 4, but the present invention is not limited to the application.

Specifically, the present invention can be applied to injectors configured such that the high-pressure port 43 is formed at the one axial end of the injector body 4, which is opposite to the other axial end formed with the spray hole 11, so that the high-pressurized fuel is supplied from the one axial end of the injector body 4.

In each of the first to fourth embodiments, the drive connecter terminal 62 and the connector terminals 63*b* to 63*e* are supported by the same connector housing 61 so that the drive connecter terminal 62 and the connector terminals 63*b* to 63*e* are designed as the single connector (single connector jack) 60. However, the drive connecter terminal 62 and the connector terminals 63*b* to 63*e* can be supported by different connector housings so that the drive connecter terminal 62 and the connector terminals 63*b* to 63*e* are designed as different connectors (different connector jacks).

In each of the first to fourth embodiments, the wire holder 55 (550, 551, or 552) is assembled into the sensor assembly As, but the wire holder 55 (550, 551, or 552) cannot be assembled into the sensor assembly As. That is, when the sensor assembly As is threadedly installed into the injector body 4, the wire holder can be designed not to be rotated together with the sensor assembly As. Far example, the sire holder can be mounted on the plate 53 after the sensor assembly As has been threadedly installed in the injector body 4.

In each of the first to fourth embodiments, as a sensing element for measuring the amount of distortion of the stem 51, the strain gauge 52 is used, but another sensing element, such as a piezoelectric device, can be used.

In each of the first to fourth embodiments, the present invention is applied to the fuel injector installed in the internal combustion diesel engine, but can be applied to direct-injection gasoline engines that directly spray fuel into their combustion chambers E1.

While there has been described what is at present considered to be the embodiments and their modifications of the present invention, it will be understood that various modifications which are not described yet may be made therein, and it is intended to cover in the appended claims all such modifications as fall within the scope of the invention.

What is claimed is:

1. A fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body while the plurality of first terminals are rotated;

a connector comprising a housing attached to the body, and a plurality of second terminals supported by the housing for external electric connection of the fuel pressure sensor;

a plurality of wires for establishing electrical connection between the plurality of first terminals and the plurality of second terminals; and a wire holder configured to hold each of the plurality of wires at least partly around the fuel pressure sensor, and shaped to extend in a direction corresponding to a rotational direction of the plurality of first terminals, and to establish contact to each of the plurality of wires, wherein the wire holder has a peripheral portion with both first and second ends, the first and second ends defining an opening therebetween, the opening being located to face the plurality of first terminals, and the wire holder is configured to hold the plurality of wires such that each of the plurality of wires passes through the opening, and each of the plurality of wires is arranged along the peripheral portion from one of the first and second ends to the other thereof.

2. The fuel injector according to claim 1, wherein the wire holder is shaped to extend in a substantially circular arc around the fuel pressure sensor.

3. The fuel injector according to claim 1, wherein the wire holder comprises a plurality of holder members arranged in a direction corresponding to a rotational direction of the plurality of first terminals, each of the plurality of holder members being configured to establish point contact with each of the plurality of wires.

4. The fuel injector according to claim 1, further comprising:

a needle valve installed in the body and working to open and close the fuel supply passage;

a driving member working to actuate the needle valve to open or close the fuel supply passage when electric power is supplied thereto; and a drive terminal electrically connected to the driving member and operative to supply therethrough the electric power to the driving element, the drive terminal being supported by the housing, the plurality of second terminals, the drive terminal, and the housing constituting the connector for the fuel pressure sensor.

5. The fuel injector according to claim 1, wherein the fuel pressure sensor comprises:

a cylindrical body having one axial end formed with a fuel inlet into which the fuel enters;

a diaphragm located to close the other axial end of the cylindrical body, the diaphragm being subjected to pressure of the fuel so as to be deformed elastically;

a sensing element attached to the diaphragm and operative to convert an amount of distortion of the diaphragm into an electric signal, the sensing element being configured to output the electric signal as the signal indicative of the pressure of the fuel; and a thread portion formed on an outer circumferential surface of the cylindrical body, the fuel pressure sensor being threadedly installed in the body by the thread portion.

6. The fuel injector according to claim 1, further comprising:

a mold circuit member comprising: a circuit component that amplifies the signal indicative of the pressure of the fuel; and a resin mold package that encapsulates the circuit component, wherein the resin mold package is shaped to extend in a direction corresponding to a rotational direction of the plurality of first terminals, the wire holder is the resin mold member that holds each of the wires at least partly around the fuel pressure sensor.

7. A fuel injector to be installed in an internal combustion engine to spray fuel from a spray hole, the fuel injector comprising:

a body having formed therein a spray hole and a fuel supply passage, the fuel supply passage, being designed such that fuel supplied thereto is delivered to the spray hole;

a fuel pressure sensor designed to produce a signal indicative of a pressure of the fuel;

a plurality of first terminals attached to the fuel pressure sensor and including at least one terminal for outputting the signal indicative of the pressure of the fuel, the fuel pressure sensor being threadedly installed in the body while the plurality of first terminals are rotated;

a connector comprising a housing attached to the body, and a plurality of second terminals supported by the housing for external electric connection of the fuel pressure sensor;

a plurality of wires for establishing electrical connection between the plurality of first terminals and the plurality of second terminals; and a wire holder configured to hold each of the plurality of wires at least partly around the fuel pressure sensor, wherein the wire holder is formed with a plurality of grooves around the fuel pressure sensor, the plurality of grooves being separately aligned in a direction around which the plurality of first terminals are rotated, the plurality of wires being fitted in the plurality of grooves, respectively.

8. The fuel injector according to claim 7, wherein the wire holder is shaped to extend in a substantially circular arc around the fuel pressure sensor.

9. The fuel injector according to claim 7, wherein the wire holder comprises a plurality of holder members arranged in a direction corresponding to a rotational direction of the plurality of first terminals, each of the plurality of holder members being configured to establish point contact with each of the plurality of wires.

10. The fuel injector according to claim 7, further comprising:

a needle valve installed in the body and working to open and close the fuel supply passage;

a driving member working to actuate the needle valve to open or close the fuel supply passage when electric power is supplied thereto; and a drive terminal electrically connected to the driving member and operative to supply therethrough the electric power to the driving element, the drive terminal being supported by the housing, the plurality of second terminals, the drive terminal, and the housing constituting the connector for the fuel pressure sensor.

11. The fuel injector according to claim 7, wherein the fuel pressure sensor comprises:

a cylindrical body having one axial end formed with a fuel inlet into which the fuel enters;

a diaphragm located to close the other axial end of the cylindrical body, the diaphragm being subjected to pressure of the fuel so as to be deformed elastically;

a sensing element attached to the diaphragm and operative to convert an amount of distortion of the diaphragm into an electric signal, the sensing element being configured to output the electric signal as the signal indicative of the pressure of the fuel; and a thread portion formed on an outer circumferential surface of the cylindrical body, the fuel pressure sensor being threadedly installed in the body by the thread portion.

12. The fuel injector according to claim 7, further comprising:

a mold circuit member comprising: a circuit component that amplifies the signal indicative of the pressure of the fuel; and a resin mold package that encapsulates the circuit component, wherein the resin mold package is shaped to extend in a direction corresponding to a rotational direction of the plurality of first terminals, the wire holder is the resin mold member that holds each of the wires at least partly around the fuel pressure sensor.

13. A fuel injector to be installed in an internal combustion engine to spray fuel from a spray hole, the fuel injector comprising:

a body having formed therein a spray hole and a fuel supply passage, the fuel supply passage being designed such that fuel supplied thereto is delivered to the spray hole;

a fuel pressure sensor designed to produce a signal of a pressure of the fuel;

a plurality of first terminals attached to the fuel pressure sensor and including at least one terminal for outputting the signal indicative of the pressure of the fuel, the fuel pressure sensor being threadedly installed in the body while the plurality of first terminals are rotated;

a connector comprising a housing attached to the body, and a plurality of second terminals supported by the housing for external electric connection of the fuel pressure sensor;

a plurality of wires for establishing electrical connection between the plurality of first terminals and the plurality of second terminals; and a wire holder configured to hold each of the plurality of wires at least partly around the fuel pressure sensor, wherein the wire holder is integrally mounted to the fuel pressure sensor.

14. The fuel injector according to claim 13, wherein the wire holder is shaped to extend in a substantially circular arc around the fuel pressure sensor.

15. The fuel injector according to claim 13, wherein the wire holder comprises a plurality of holder members arranged in a direction corresponding to a rotational direction of the plurality of first terminals, each of the plurality of holder members being configured to establish point contact with each of the plurality of wires.

16. The fuel injector according to claim 13, further comprising:

a needle valve installed in the body and working to open and close the fuel supply passage;

a driving member working to actuate the needle valve to open or close the fuel supply passage when electric power is supplied thereto; and a drive terminal electrically connected to the driving member and operative to supply therethrough the electric power to the driving element, the drive terminal being supported by the housing, the plurality of second terminals, the drive terminal, and the housing constituting the connector for the fuel pressure sensor.

17. The fuel injector according to claim 13, wherein the fuel pressure sensor comprises:

a cylindrical body having one axial end formed with a fuel inlet into which the fuel enters;

a diaphragm located to close the other axial end of the cylindrical body, the diaphragm being subjected to pressure of the fuel so as to be deformed elastically;

a sensing element attached to the diaphragm and operative to convert an amount of distortion of the diaphragm into an electric signal, the sensing element being configured to output the electric signal as the signal indicative of the pressure of the fuel; and a thread portion formed on an outer circumferential surface of the cylindrical body, the fuel pressure sensor being threadedly installed in the body by the thread portion.

18. The fuel injector according to claim 13, further comprising:

a mold circuit member comprising: a circuit component that amplifies the signal indicative of the pressure of the fuel; and a resin mold package that encapsulates the circuit component, wherein the resin mold package is shaped to extend in a direction corresponding to a rotational direction of the plurality of first terminals, the wire holder is the resin mold member that holds each of the wires at least partly around the fuel pressure sensor.

* * * * *